US010132049B2

(12) United States Patent
Haydu

(10) Patent No.: US 10,132,049 B2
(45) **Date of Patent: *Nov. 20, 2018**

(54) INTEGRATED BALLAST MAT

(71) Applicant: VERSAFLEX, INC., Riverside, CA (US)

(72) Inventor: Joseph Haydu, Riverside, CA (US)

(73) Assignee: Versaflex, Inc., Riverside, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/240,603

(22) Filed: Aug. 18, 2016

(65) Prior Publication Data

US 2017/0198446 A1 Jul. 13, 2017

Related U.S. Application Data

(63) Continuation of application No. 13/677,198, filed on Nov. 14, 2011, now Pat. No. 9,441,335.

(51) Int. Cl.

| | |
|---|---|
| ***E01D 19/08*** | (2006.01) |
| ***E01B 1/00*** | (2006.01) |
| ***E01B 2/00*** | (2006.01) |

(52) U.S. Cl.

CPC ..... *E01D 19/083* (2013.01); *E01B 1/001* (2013.01); *E01B 1/008* (2013.01); *E01B 2/003* (2013.01); *E01B 2204/01* (2013.01); *E01B 2204/07* (2013.01)

(58) Field of Classification Search

CPC ..... E01D 29/083; E01B 1/008; E01B 2/003; E01B 2204/01; E01B 2204/07; E01B 1/001

USPC ..... 14/73, 77.1; 404/17, 31, 75

See application file for complete search history.

(56) References Cited

U.S. PATENT DOCUMENTS

| | | | | | |
|---|---|---|---|---|---|
| 2,420,833 | A * | 5/1947 | Monroe | E01B 1/001 | 238/2 |
| 3,587,964 | A * | 6/1971 | Cork | E01B 2/003 | 14/73 |
| 4,235,371 | A * | 11/1980 | Kohler | E01B 1/001 | 238/382 |
| 4,311,273 | A * | 1/1982 | Marsh | E01B 1/008 | 14/73 |
| 4,420,513 | A * | 12/1983 | Coke | B05D 7/24 | 404/27 |
| 4,500,037 | A * | 2/1985 | Braitsch | E01B 19/06 | 404/47 |
| 5,024,554 | A * | 6/1991 | Benneyworth | E01D 19/06 | 404/47 |

(Continued)

FOREIGN PATENT DOCUMENTS

| | | |
|---|---|---|
| GB | 1361791 | 7/1974 |
| GB | 2003962 | 9/1978 |

(Continued)

*Primary Examiner* — Raymond W Addie

(74) *Attorney, Agent, or Firm* — Knobbe, Martens, Olson & Bear, LLP

(57) ABSTRACT

A protective coating system for a railway structure having a waterproof membrane and a ballast mat. The waterproof membrane is disposed on the railway structure. The ballast mat further has a ballast protection coating and a sealing layer. The ballast protection coating is a rubber compound and is disposed on the waterproof membrane. The sealing layer is disposed on the ballast protection layer.

31 Claims, 3 Drawing Sheets

(56) References Cited

U.S. PATENT DOCUMENTS 5,096,772 A * 3/1992 Snyder ..... B29B 17/0042 152/531
5,411,352 A * 5/1995 Eren ..... E01C 13/065 404/31
5,487,501 A * 1/1996 Engst ..... E01B 1/00 238/2
5,525,416 A * 6/1996 Katz ..... B32B 27/12 156/278
5,605,721 A * 2/1997 Di Geronimo ..... C08L 9/00 156/330.9
5,738,279 A * 4/1998 Ihle ..... E01B 9/683 238/2
6,055,693 A * 5/2000 Lehr ..... E01B 2/003 14/73
6,060,555 A * 5/2000 Wright ..... B05B 7/2489 427/340
6,235,136 B1 * 5/2001 Kittson ..... B29C 63/0021 156/166
6,896,964 B2 * 5/2005 Kvesic ..... C08L 19/003 427/222
7,687,104 B2 * 3/2010 Moon ..... C08L 95/00 404/17
7,896,255 B2 * 3/2011 Frenzel ..... E01B 1/001 238/2
8,240,430 B2 8/2012 Downey
8,540,430 B2 * 9/2013 Janssen ..... B60J 7/02 384/26
2003/0091831 A1 * 5/2003 Mickey ..... A01K 1/015 428/423.1
2006/0032807 A1 * 2/2006 Sansalone ..... B01D 15/00 210/263
2008/0248887 A1 * 10/2008 Shaneour ..... E01C 13/065 472/92
2009/0152368 A1 * 6/2009 Frenzel ..... E01B 1/001 238/2
2010/0294847 A1 * 11/2010 Carels ..... E01B 1/002 238/2
2012/0237296 A1 * 9/2012 Lemons ..... E01C 11/005 404/82
2012/0305663 A1 * 12/2012 Axton ..... E01B 1/001 238/2
2013/0206853 A1 * 8/2013 Robinson ..... E01B 1/00 238/2
2015/0040330 A1 * 2/2015 Kudrenski ..... E01D 19/083 14/77.1

FOREIGN PATENT DOCUMENTS

RU 2360063 6/2009
RU 2010125863 5/2010

* cited by examiner

INTEGRATED BALLAST MAT

BACKGROUND

Field of the Invention

This application relates to ballast mats for use in railway structures.

Background

Railway structures, such as rail bridge decks, suffer deterioration from the corrosive effects of both natural and man-made agents. Freeze/thaw cycles, repeated day after day, year after year, also deteriorate the structures. Ballast, such as rock or gravel, can add additional challenges for rail bridge decks because of the punishing effects of its angularity. The tremendous pounding of high point loads adds to the challenge. Additionally, railway bridges are continually in a state of motion. Expansion and contraction caused by changes in thermal conditions, deflections caused by live loads, and longitudinal forces caused by railway traffic all combine to produce nearly continuous motion in the decks of railway bridges.

One method of protecting the railway structures is by using rigid ballast protection plates. Ballast protection plates can be used to help protect the railway structures against ballast and the harmful effects of corrosive elements, such as water, salts, and chemicals. Generally, the ballast protection plates are 4 foot by 8 foot sheets of ½" thick asphalt planking. The ballast protection plates are expensive, heavy, and cumbersome to work with. Additionally, railway structures may be uneven and the ballast protection plates may not sit flat. In such cases, grout, cement, or another type of patch would need to be applied to make the surfaces level, which can add further complications. Further, the ballast protection plates can allow water, chemicals, and other corrosive elements to seep through the ballast and corrode the railway structures.

There is a need in the art for a railway protection system that can protect against ballast and the harmful effects of other corrosive elements without the drawbacks of rigid ballast protection plates.

SUMMARY

The systems, methods, and devices of the invention each have several aspects, no single one of which is solely responsible for its desirable attributes. Without limiting the scope of the invention, certain features will now be discussed briefly. In one embodiment, the invention comprises a protective coating system for a railway bridge structure having ballast and a railway track structure comprising a waterproof membrane disposed on the railway bridge structure, wherein the waterproof membrane forms a substantially waterproof seal on the railway bridge structure. In this aspect, the invention further comprises a ballast protection coating adhered to the waterproof membrane, the ballast protection coating including a filler, such as rubber compound and resin, wherein the ballast protection coating is formed from a plurality of layers, wherein the ballast protection coating is compressible wherein the ballast protection coating is configured to protect the waterproof membrane from damage caused by operation of the railway track structure.

In another embodiment the invention comprises a protective coating system for a railway structure comprising a waterproof membrane disposed on the railway structure; and a ballast mat further comprising a ballast protection coating disposed on the waterproof membrane, wherein the ballast protection coating is composed of, at least in part, a rubber compound; and a sealing layer disposed on the ballast protection layer.

In another embodiment, the invention comprises a method of coating a deck of a railway structure with a protective coating, the method comprising: applying a waterproof membrane on the deck of a railway structure, wherein the waterproof membrane is applied by spraying the waterproof membrane on the bridge structure. The method further comprises applying a ballast protection layer on the waterproof membrane, wherein the ballast protection coating is applied by spraying the ballast protection coating on top of the waterproof membrane; and applying a seal coat on the ballast protection coating; wherein the seal coat is applied by spraying the seal coat on the ballast protection coating.

These and other objects and advantages of the present invention will become more apparent from the following description taken in conjunction with the accompanying drawings.

BRIEF DESCRIPTION OF THE DRAWINGS

Certain embodiments of the disclosure will now be discussed in detail with reference to the following figures. These figures are provided for illustrative purposes only, and the disclosure is not limited to the subject matter illustrated in the figures.

DETAILED DESCRIPTION

Embodiments of the invention will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

The term "mil" and "mils" is used throughout the disclosure as a unit of measurement that refers to a thousandth of an inch. For example, 20 mils refers to 20 thousandths of an inch.

Figure 1:
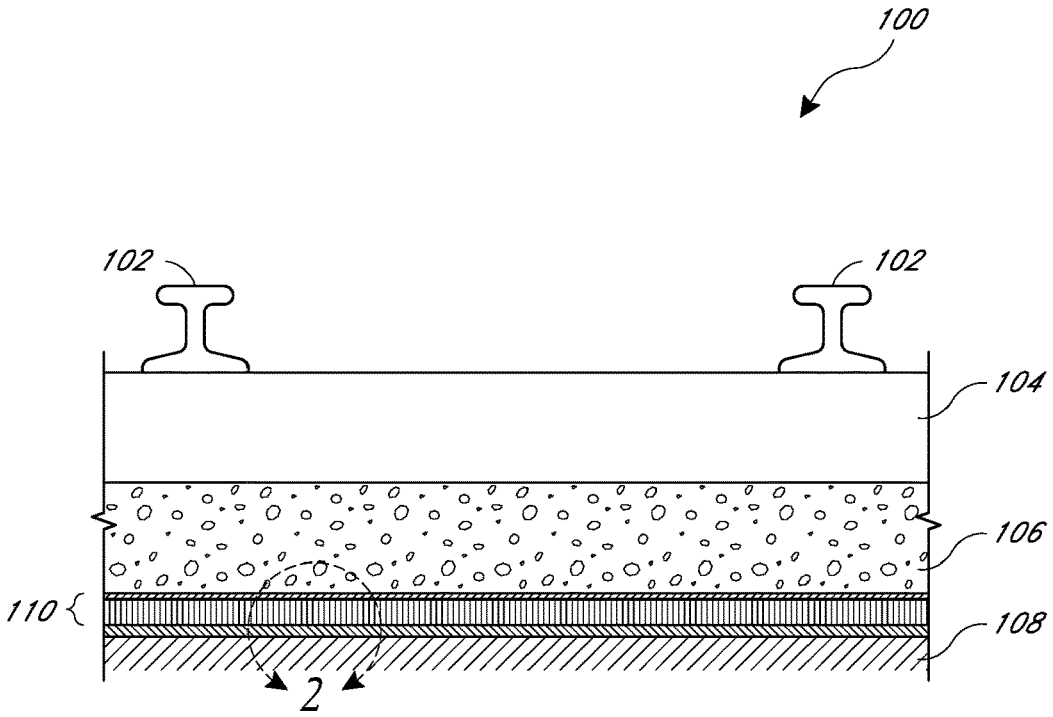
FIG. 1 is a cross-sectional view of one embodiment of a ballast mat installed in a railway bed application.

FIG. 1 illustrates a cross sectional view of one embodiment of a railway track 100. The railway track 100 can include rails 102, railway ties 104, and ballast 106, such as crushed rock or gravel. The rails 102 are installed on the railway ties 104 and positioned on the ballast 106. The railway track 100 is supported on a railway bed 108, such as packed earth, concrete, asphalt, concrete and steel rail bridge structures, tunnels, and other structures. The illustrated embodiment shows one embodiment of a railway system, other railway systems are also contemplated, including railroad, light rail, subway systems, and elevated rail structures. A railway protection system is disposed between the railway bed 108 and the ballast 106. The railway protection system includes a waterproof membrane 116 and an integrated ballast mat 110.

Figure 2:
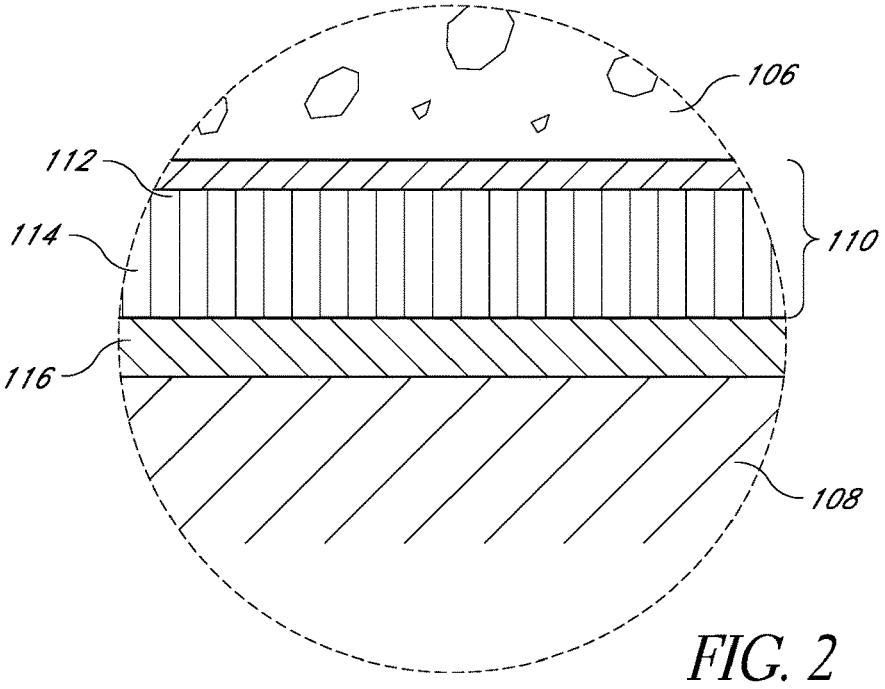
FIG. 2 is a partial section view of an embodiment of a ballast mat illustrated in FIG. 1.

A more detailed view of the railway protection system is illustrated in FIG. 2. The waterproof membrane is applied to the railway bed 108. The waterproof membrane 116 is an elastomeric coating that can be a polyurea, such as Bridge Deck Top Coat™ available from Bridge Preservation a division of Versaflex Inc. of Kansas City, Mo. Preferably, the waterproof membrane 116 is formed from a material that can protect against water, salts, chemicals, and other corrosive elements. The waterproof membrane 116 can be applied by spraying the material while it is in a substantially fluid state. The waterproof membrane 116 can be applied along any length of the railway bed 106. The waterproof membrane 116 can be uniformly applied over irregular surfaces and can be applied horizontally, vertically and overhead. The thickness of each the layer of waterproof membrane 116 can be between 10 and 150 mils thick, and can be between 60 and 120 mils thick. In one embodiment, the waterproof membrane 116 can be 80 mils thick. In some embodiments one or more layers of the waterproof membrane 116 can be applied on top of each other. In one embodiment a first layer of the waterproof membrane 116 is 40 mils thick and a second layer of the membrane 116 is 40 mils thick. The waterproof membrane 116 can be applied so that it has a substantially uniform thickness. In some embodiments the waterproof membrane 116 can be applied having varying thicknesses.

The waterproof membrane 116 can cover all or part of railway bed 108. For example on a bridge, the waterproof membrane 116 can cover the entire surface of the bridge deck. In some instances the waterproof membrane will extend out to a predetermined position or location, such as a drainage area. Preferably, the waterproof membrane 116 defines a fluid tight seal on the surface of the railway bed 108. Preferably, the waterproof membrane 116 can cover the railway bed without seams, which can reduce weak points in the fluid tight seal.

In some embodiments an adhesive or primer layer can be installed (not shown). The adhesive layer can be a primer application and can be applied prior to the placement of the waterproof membrane 110. The adhesive layer can be the same material as all or part of the waterproof membrane 110, such as a polyurea. The adhesive layer can be applied by spraying or rolling the material while it is in a substantially fluid state. In some embodiments the adhesive layer can be between 2 mils and 10 mils thick.

The integrated ballast mat 110 includes a ballast protection coating 114 and a seal coat 112. The ballast protection coating 114 is applied directly to the waterproof membrane 116 and the seal coat is applied to the ballast protection coating 114. The ballast protection coating 114 provides a ballast protection course for the waterproofing membrane 116. The ballast protection coating 114 is an elastomeric coating, which can be composed of a rubber compound, such as styrene-butadiene (SBR) rubber, and resin as well as other materials that will absorb the weight of the train when the train is compressing the ballast. In one specific implementation, a 40 mil layer of resin, then a layer of broadcast rubber or other filler material, then another 40 mil layer of broadcast rubber, then optionally a seal coat can be used to form a coating thicker 250 to 300 mil system. In some embodiments the ballast protection coating 114 can be applied by spraying the material while it is in a substantially fluid state. In other embodiments the ballast protection coating 114 can be broadcast in a dry form, such as ground up tires, and a resin coating applied over the dry layer. The ballast protection coating 114 is applied on top of the waterproof membrane 116. The ballast protection coating 114 can cover substantially all of the waterproof membrane 116. In some embodiments the ballast protection coating 114 covers only a portion of the waterproof coating 114. Preferably, the ballast protection coating 114 covers all of the waterproof membrane 116 where ballast is positioned above the waterproof membrane 116.

One or more layers of the ballast protection coating 114 can be applied. Or, alternatively, repeated layers of resin and filler can then be applied to achieve a desired thickness at which point the seal coat can be applied. The thickness of each the layer of the ballast protection coating 114 can be between 10 and 150 mils thick, and can be between 30 and 50 mils thick. In one embodiment the ballast protection coating 114 has two layers that are 40 mils thick. In another embodiment the ballast protection coating 114 has three layers that are 40 mils thick. In one embodiment, the combined thickness of the layers of the ballast protection coating 114 can be 250 mils. The thicknesses can vary depending upon the application.

The ballast protection coating 114 protects the waterproof membrane 116 from damage caused by operation of the railway as it absorbs the compressive forces of the ballast as the train travels over the structure. The ballast protection coating 114 can also provide additional waterproofing protection. By protecting the waterproof membrane 116, the ballast protection coating 114 protects the underlying structure from water infiltration which can cause corrosion and structural deterioration over prolonged periods of time. Moreover, the resin and filler may also inhibit water intrusion. Preferably, the ballast protection coating 114 can be used for concrete, steel, and other rail structures.

The seal coat 112 is applied to the ballast protection coating 114. The seal coat 112 binds and seals the ballast protection layer 114. The seal coat can be any type of sealant. The seal coat 112 can be applied by spraying the material while it is in a substantially fluid state. The seal coat 112 substantially covers the ballast protection layer 114. The thickness of the seal coat 112 can be between 10 and 150 mils. In one embodiment the seal coat can be 40 mils. In one embodiment the seal coat 112 can be the same material as all or part of the waterproof membrane 116, such as a polyurea. The seal coat can be applied on top of the layers of resin and filler or may also be intermixed in the layers.

The ballast mat 110 and waterproof membrane 116 provide increased dielectric resistance between railway tracks and the underlying railway structure 108. The dielectric resistance helps insulate the underlying railway structure 108 from stray current emanating from the railway tracks, such as light-rail tracks, that can cause accelerated corrosion on unprotected structures. The ballast mat 114 can also dampen noise and vibration that comes from the operation of the railway. The ballast mat can absorb and reduce vibrations that come from the rails through the ballast.

Figure 3:
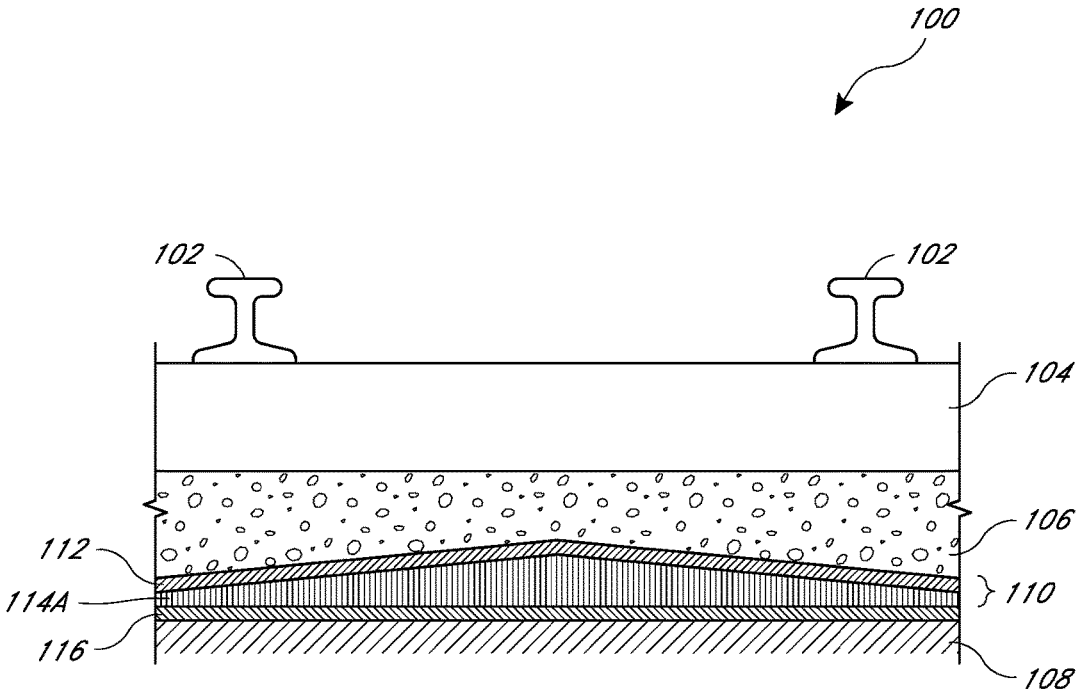
FIG. 3 is a cross-sectional view of another embodiment of a ballast mat installed in a railway bed application.

FIG. 3 illustrates an alternate embodiment of the ballast protection coating 114A. The layers of the ballast protection coating 114A can be applied to shape the profile of the ballast mat 110. Different profiles are formed by applying different numbers of layers of the ballast protection coating 114. In the embodiment in FIG. 3 the ballast protection coating 114A has been formed so that it slopes downward from the apex to the outer edges. The shape of the ballast protection coating 114A can help direct the flow of water down the sides and away from the center of the railway bed 108. The ballast protection coating 114 can be shaped into other profiles depending on the specific application. For example, the ballast protection coating 114 can be applied at varying thickness to provide slop on a flat bridge deck. In another example, the ballast mat 110 can be shaped to direct runoff to a specific location, or the ballast mat 110 can be shaped to avoid pooling of water caused by irregular or uneven surfaces. Illustratively, the ballast protection coating can be applied to irregular or uneven surfaces at varying thicknesses to form level or uniformly sloped surfaces.

Figure 4:
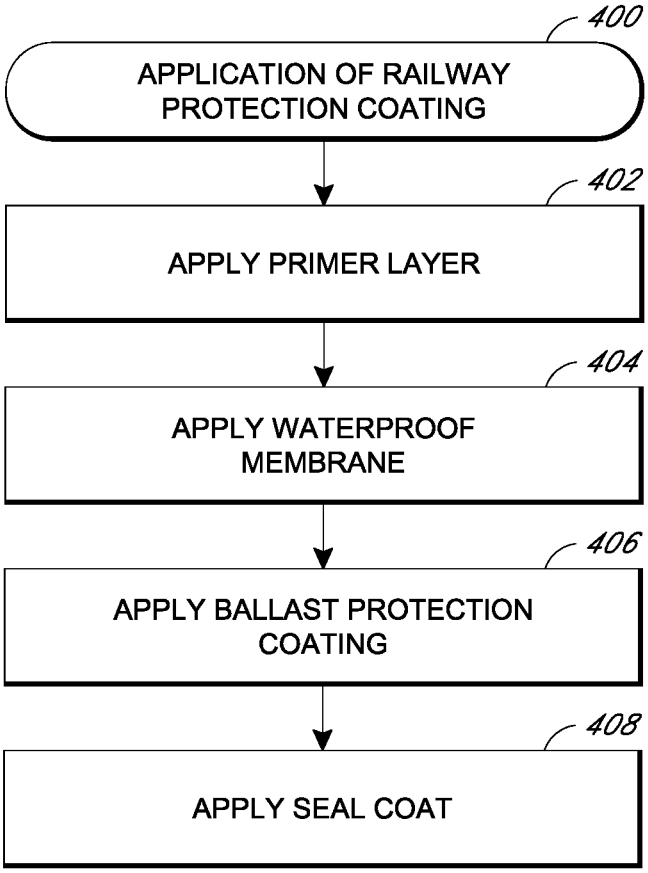
FIG. 4 illustrates an embodiment of a flowchart for a method of applying the railway protection coating to a railway structure.

FIG. 4 is an illustrative flowchart showing the application the railway protection coating to a railway structure 400. At block 402, a primer or adhesive layer can be optionally applied to a railway structure, such as a bridge deck, prior to the application of the waterproof membrane. The adhesive layer can be applied by spraying the primer when it is in a substantially fluid state. The adhesive layer can also be applied by roller or other equipment. In some embodiments the primer can be between 2 mils and 10 mils. The primer can help seal surfaces prior to the application of the waterproof membrane.

At block 404, the waterproof membrane is applied to the railway structure. The waterproof membrane can be applied by spraying the waterproof membrane when it is in a substantially fluid state. The waterproof membrane can be applied as a specified thickness in one continuous application. In one embodiment the waterproof membrane is 80 mils. The waterproof membrane can be used to coat the entire railway structure and can be sprayed horizontally, vertically, and overhead. Preferably the waterproof membrane is applied to provide a continuous seamless waterproofing membrane on the railway structure. Illustratively, on a bridge deck, a substantially uniform waterproof membrane could be applied to the entire bridge deck. Preferably, the waterproof membrane creates a substantially seamless protective coating between the bridge deck and water, salts, chemicals, and other corrosive elements.

At block 406, a ballast protection coating is applied over the waterproof membrane. The ballast protection coating can be applied in one or more layers. The ballast protection coating can be applied by spraying the ballast protection coating when it is in a substantially fluid state. The ballast protection coating provides protection against ballast impact to the waterproof membrane. The ballast protection coating also provides additional seamless waterproofing protection. The ballast protection coating can be applied as a series of layers of resin, then filler, then resin, etc. The layers can be applied to the railway structure non-uniformly. For example, layers of the ballast protection coating can be applied to shape or slope the surface of the railway structure. The ballast protection coating can also be used to fill in and level uneven and irregular surfaces. In some embodiments the ballast protection coating can be a uniform thickness. In one embodiment the ballast protection coating has a thickness between 230 mils and 260 mils.

At block 408 a seal coat is applied over the ballast protection coating. The seal coat can be applied by spraying the material while it is in a substantially fluid state. The seal coat seals the ballast protection coating and helps create a protective finish coating on the ballast mat. The seal coat can be applied as a substantially uniform layer over the entire ballast protection coating.

As discussed above, the ballast protection coating includes a filler material that can be ground up rubber. But other fillers such as rock, plastic, synthetic fiber can also be used without departing from the spirit and scope of the present invention.

The foregoing description details certain embodiments. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A protective coating system for a bed of a railway structure having ballast and a railway track structure, comprising:

a cure in place waterproof membrane configured to be disposed on a bed of the railway structure, wherein the waterproof membrane forms a substantially waterproof seal on the bed of the railway structure and wherein the waterproof membrane is adhered to the bed of the railway structure;

a ballast protection coating adhered to the waterproof membrane, the ballast protection coating including a filler and a resin, wherein the ballast protection coating is compressible; and wherein the ballast protection coating protects the waterproof membrane from damage caused by operation of the railway track structure, and wherein one or both of the waterproof membrane and ballast protection coating have dielectric properties.

2. The system of claim 1, wherein the filler is rubber.

3. The coating of claim 1, wherein the thickness of the waterproof membrane is less than the thickness of the ballast protection coating.

4. The coating of claim 1, wherein the ballast protection coating has a variable thickness.

5. The coating of claim 1, wherein the protective coating system forms a substantially seamless waterproof coating over the bed of the railway structure.

6. The coating of claim 1, further comprising a primer layer, wherein the primer layer is disposed on the bed of the railway structure and the waterproof membrane is disposed on the primer layer.

7. The coating of claim 1, wherein the ballast protection coating is waterproof and inhibits water intrusion.

8. A protective coating system for a railway structure, comprising:

a cure in place waterproof membrane disposed on the railway structure and wherein the waterproof membrane is adhered to the railway structure; and a ballast mat further comprising, a ballast protection coating disposed on the waterproof membrane, wherein the ballast protection coating is composed of, at least in part, a filler compound; and a sealing layer disposed on the ballast protection layer, wherein the ballast protection coating is interposed between the sealing layer and the waterproof membrane along an entire span of the sealing layer.

9. The coating of claim 8, wherein the railway structure is a bridge structure.

10. The coating of claim 9, wherein the waterproof membrane and the ballast mat substantially cover an upper surface of the bridge structure.

11. The coating of claim 9, wherein the ballast mat covers substantially the entire railway structure.

12. The coating of claim 8, wherein the filler is a rubber compound.

13. The coating of claim 12, wherein the rubber compound includes styrene-butadiene rubber.

14. The coating of claim 8, wherein the ballast protection coating has a plurality of layers.

15. The coating of claim 8, wherein the thickness of the ballast protection coating is greater than the thickness of the waterproof membrane.

16. The coating of claim 8, wherein the thickness of the ballast protection coating is between approximately 200 mils and 300 mils.

17. The coating of claim 8, wherein the thickness of the waterproof membrane is between approximately 60 mils and 120 mils.

18. The coating of claim 8, wherein the thickness of the sealing layer is between 20 mils and 60 mils.

19. The coating of claim 8, wherein the ballast protection coating has a variable thickness.

20. The coating of claim 8, wherein the ballast protection coating is shaped to create a slope relative to the railway structure.

21. The coating of claim 8, wherein the waterproof membrane and the ballast mat are substantially parallel.

22. The coating of claim 8, wherein the ballast mat is a substantially uniform thickness.

23. The coating of claim 8, wherein the ballast protection coating has a substantially triangular cross-sectional profile.

24. The coating of claim 8, wherein the ballast mat has dielectric properties.

25. The coating of claim 8, wherein the ballast mat forms a substantially seamless waterproof coating over the railway structure.

26. A method of coating a deck of a railway structure with a protective coating, the method comprising:

applying a cure in place waterproof membrane on the deck of a railway structure, wherein the waterproof membrane is applied by spraying the waterproof membrane on the railway structure and is adhered to the deck of the railway structure;

applying a ballast protection layer on the waterproof membrane, wherein the ballast protection coating is applied by distributing the ballast protection coating on top of the waterproof membrane; and applying a seal coat on the ballast protection coating; wherein the seal coat is applied by spraying the seal coat on the ballast protection coating.

27. The method of claim 26, further comprising applying additional ballast protection layers to form a ballast protection coating having a non-uniform thickness.

28. The method of claim 26, further comprising applying a primer layer to the deck of the railway structure.

29. The method of claim 26, wherein the ballast protection layer substantially covers the waterproof membrane.

30. The method of claim 26, further comprising positioning a ballast material on the ballast protection layer.

31. The coating of claim 8, wherein the sealing layer is adhered solely to the ballast protection coating.

* * * * *